United States Patent [19]

Pinkus

[11] 4,176,839

[45] Dec. 4, 1979

[54] WRIST SUPPORT

[76] Inventor: Alan E. Pinkus, 4 Albert St., Brighton, Victoria, Australia

[21] Appl. No.: 901,846

[22] Filed: May 1, 1978

[30] Foreign Application Priority Data

May 2, 1977 [AU] Australia ..... PC9934

[51] Int. Cl.[2] ..... A63B 69/38

[52] U.S. Cl. ..... 273/29 A; 273/189 A; 2/161 A; 128/165; 273/54 B

[58] Field of Search ..... 273/54 B, 189 R, 189 A, 273/29 R, 29 A, 26 C; 128/165, 89 R; 2/161 A, 159; 272/67

[56] References Cited

U.S. PATENT DOCUMENTS

| | | | |
|---|---|---|---|
| 1,471,948 | 10/1923 | Cox | 128/89 R |
| 2,794,638 | 6/1957 | Risher et al. | 273/54 B |
| 2,994,533 | 8/1961 | Pupilla, Jr. | 273/189 R |
| 3,062,546 | 11/1962 | Horton et al. | 273/54 B |
| 3,238,939 | 3/1966 | Stubbs | 273/54 B |
| 3,269,728 | 8/1966 | Blough | 273/54 B |
| 3,408,077 | 10/1968 | Norwood | 273/189 A |
| 3,423,095 | 1/1969 | Cox | 273/189 A |
| 3,533,407 | 10/1970 | Smith | 273/189 A |
| 3,593,339 | 7/1971 | Main | 2/161 A |
| 3,598,408 | 8/1971 | Klose | 273/189 A |
| 3,606,343 | 9/1971 | Lemon | 273/189 R |
| 3,700,245 | 10/1972 | Nannini | 273/189 A |
| 4,040,632 | 8/1977 | Pawl | 273/189 A |

*Primary Examiner*—Richard C. Pinkham
*Assistant Examiner*—T. Brown
*Attorney, Agent, or Firm*—Bacon & Thomas

[57] ABSTRACT

A wrist support device intended as a sports aid but adapted especially for tennis and like sports for enhancing stroke power while providing wrist support. The device includes a wrist band and a protruding support for the underside of the hand. The support is disposed at an angle between 45° and 80° to the flattened band and is arranged to exert an outward force of at least ½ kg. force when in the plane of the flattened band.

8 Claims, 4 Drawing Figures

WRIST SUPPORT

BACKGROUND TO THE INVENTION

This invention is applicable to sports such as tennis, badminton and squash entailing the use of a racquet or like implement held in one hand.

One source of mistimed shots in tennis is "droopy wrist" or a momentary dropping of the hand under the weight of the racquet at the critical moment when the racquet contacts the ball. This causes undercut on the ball when a full face strike was intended. A traditional approach to the elimination of this weakness has been to provide binding on the wrist in order to prevent it from dropping marginally as the stroke is played. Another known approach is a device such as the "Power-Play" trainer marketed by Concept House Inc. in which the racquet handle is fastened to a bracelet worn by the player by a tie which limits the downward movement of the hand and racquet.

The problem of wrist control has also been of concern in the fields of golfing and bowling and the literature includes various proposals for a style of accessory which is secured to the wrist and extends under the underside or back of the hand towards the region of the base of the fingers. Reference is made, for example, to U.S. Pat. No. 3,269,728 to Blough which discloses a rigid, moulded wrist support for bowlers which is held to the wrist and hand by spaced straps. The bowler's wrist support illustrated in U.S. Pat. No. 2,794,638 to Risher et al. is similar in concept but provides built-in buckles and a rectangular rigidifying strip of aluminium or the like.

The golfer's interest is represented by U.S. Pat. Nos. 3,423,095 to Cox and 3,700,245 to Nannini. Both of these papers provide a relatively broad band extending adjacent the back of the hand and held to the wrist by twin Velcro type fastener straps. Cox describes the band as rigid while Nannini recommends a "semi-rigid" band exhibiting a "very slight amount of flexibility" so as to be "not unduly rigid."

A device not structurally dissimilar to the above mentioned supports, but intended for a very different purpose, is the thumb and wrist protector of U.S. Pat. No. 1,471,948 to Cox et al. Here the thumb side of the hand lies adjacent a band which carries a reinforcing strip of leather and is tied to the wrist and thumb.

The present invention had found that none of these devices is wholly or even partly satisfactory for the strengthening of the wrist in tennis and like sports such as badminton and squash. Accordingly, it is an object of the invention to provide a device which at least in part resolves this difficulty.

SUMMARY OF THE INVENTION

The invention provides, in a wrist support device for use in tennis comprising:

a band of breathable flexible material;

means to permit fastening of said band about the wrist; and a protruding portion extending integrally from the band in a direction to engage and support the side edge of the hand between the wrist and smallest finger;

the improvement wherein the protruding hand engaging portion extends from the band at an angle to the band, in the plane of the flattened band, in the range 45° to 80° and wherein the protruding portion is biased to adopt an equilibrium position out of said plane on the side of the band to be occupied by the hand, the outward force exerted when the protruding portion is restrained to occupy said plane being greater than ½ kgm force (4.9 newton).

Advantageously, the recited angle may be in the range 55° to 65° while the specified outward force, is preferably not greater than 3 kgm force, most suitably 1 to 2 kgm force.

The rearward portion is preferably capable of extending around the wrist of the wearer as a pair of flaps securable together by tying or by other means such as cooperable Velcro type loop and pile pads. Alternatively, the band may be held in place by a separate tie element such as the conventional sweat band tightly wrapped around the rearward portion of the support or located through slots in the support.

The device may include a loop extending from the end of the protruding hand engaging portion which is remote from the band for supporting the device from the smallest finger.

It is believed by the inventor, but not yet firmly established, that in addition to its training function, the support of the invention is also of assistance in lessening the occurrence of "tennis elbow". It is thought that this condition arises from the continued strain occasioned by the weight of the tennis racquet on the joints of the arm and that by strengthening the wrist joint after the manner of the invention, this strain can be reduced.

BRIEF DESCRIPTION OF THE DRAWINGS

The invention will be further described by way of example only with reference to the accompanying drawings, in which.

DESCRIPTION OF PREFERRED EMBODIMENT

The illustrated wrist support device 10 includes a band 12 of sufficient length to overlap about the wrist and, integrally formed with the band, a protruding portion 14 dimensioned to extend along the underside of the hand towards the base of the smallest finger. As illustrated, the device is intended to fit a right hand.

Figure 2:
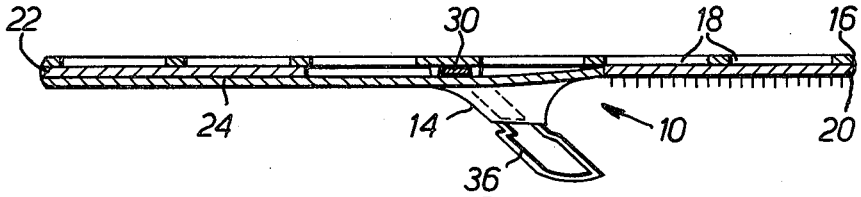
FIG. 2 is a cross-section on the line 2—2 in FIG. 1.
Figure 3:
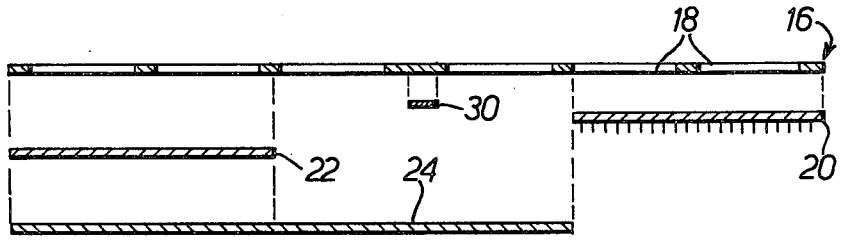
FIG. 3 is an exploded view corresponding to FIG. 2.
Figure 4:
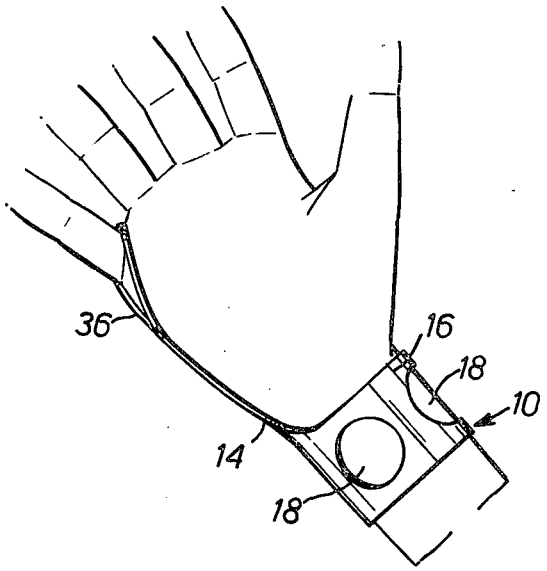
FIG. 4 illustrates the device in position on the racquet hand of the tennis player.

Band 12 and protruding portion 14 are formed in a material which is of adequate strength and flexibility. The material should also be capable of breathing when in close proximity to the skin in order to minimise discomfort to the wearer during relatively prolonged active use. More specifically, band 12 and protruding portion 14 are of high frequency bonded laminated construction best seen in FIGS. 2 and 3. The primary laminate is an outer covering 16 of a suitable polyvinyl chloride or other plastics material which is treated so as to be resistant to ultraviolet degradation and is punched across the length of the band with a series of six large, closely spaced circular openings 18. On that face of laminate 16 which is use faces the wrist is mounted fastening means in the gvise of respective Velcro loop and pile elements 20, 22. These elements each cover two of the openings 18 at opposite ends of the band, the arrangement being such that on closure of the band about the wrist of a wearer, the loop element 20 overlaps the opposite end of the band and engages the pile element through the then intervening openings 18 closed by the pile element.

The inside face of pile element 22 and the portion of PVC laminate 16 left exposed between the loop and pile elements are laminated to a strip 24 of soft-backed polyvinyl chloride, the backing of which contacts the skin of the wearer. Strip 24 is the only thickness at the centre openings 18 and thus one or other of these is intended to locate over the wrist bone of the wearer. Where desired, laminate 24 may overlap a a further layer comprising a suitable perspiration absorbent material.

Bridging the centre region of band 12 and the protruding portion 14 is a bent strip of spring steel 30 which is sandwiched between PVC laminates 16, 24 and located during assembly of the device by upset lugs 28. Strip 30 is comprised of two straight portions, a first, 32, extending transversly of the band to a point closely adjacent the longitudinal edge of the band remote from protruding portion 14, and a second, 34, extending approximately down the centre of of the protruding portion. It will be noted that the bend in the steel strip is on the line of the longitudinal edge of band 12 at this side of the device and that the straight portion 34 of the strip shares an approximate centre line with a loop 36 high frequency bonded to and extending from the remote end of protruding portion 14.

Figure 1:
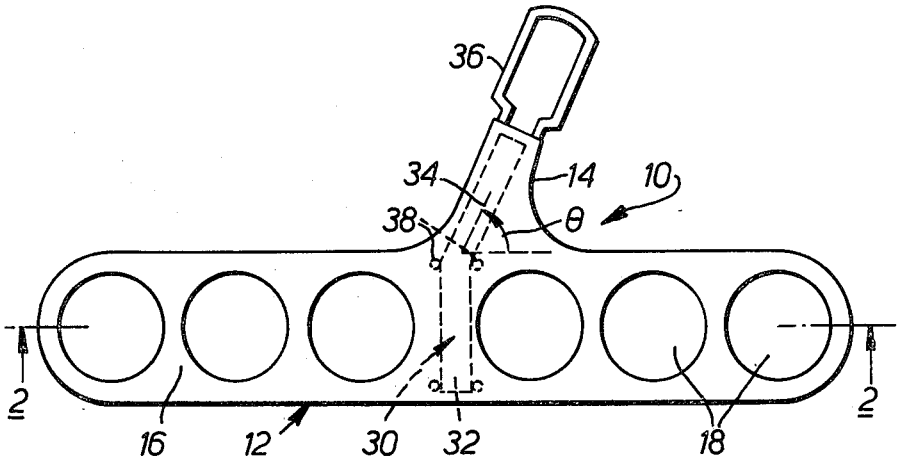
FIG. 1 is a plan view of a wrist support device constructed in accordance with the invention.

As best seen in FIG. 1, protruding portion 14 extends, in the plane of the flattened band 12, at an angle to the band, or more precisely, to the longitudinal dimension of the band. This angle, which in the illustrated example, is best considered to be the angle O between the band and the centre line of support afforded by the portion 14, such line coinciding with the centre line of the metal strip and finger engaging loop, is ideally about 60°. The intenvor has found that the extent of this angle is important in the success of the device as an aid for tennis, badminton, squash and the like, that the angle is surprisingly effective in enhancing power at impact with the ball while maximising support for the wrist.

The preferred range for the angle O is 55° to 65° although an angle in the range 45° to 80° will usually be acceptable. Certainly, an angle of substantially 90°, which is typical of some of the prior art devices hereinbefore referred to in connection with golf and bowling, is found to be quite unsatisfactory. An angle of less than 45° is found to be not adequately effective in improving stroke power and wrist support.

A further significant feature of the illustrated device is that the metal strip 30 is, as mentioned, of spring metal. It is disposed so that the protruding portion is biased to adopt an equilibrium position out of the plane of the flattened band on the side of the band intended to contact the wrist when worn by the player. More specifically, the arrangement is such that the upward force exerted when the protruding portion is restrained to occupy the plane of the flattened band is greater than ½ kgm force. It is found by the inventor that a rigid support for the underside of the hand is quite undesirable for a tennis player and indeed may well lead to injury of the hand or wrist. In accordance with the invention, there is provided a support of sufficient strength to prevent the "droopy wrist" condition while allowing an adequate freedom of movement of the hand under other playing conditions.

It is believed that the force applied to the hand by the spring loaded protruding portion when the latter is restrained to occupy the plane of the flattened band may be in the range ½ to 3 kgm force, but ideally in the range 1 to 2 kgm force with the upper limit being preferred for men and the lower limit for woman. Indeed, in case of male players, a force greater than 2 kgm force may be desired or required and this must be determined on an individual basis.

As mentioned, the device illustrated is for right hand use. A left hand device can be readily formed for the same laminations by simply inverting the order of their lamination in the die. Variations of hand size can be allowed for without modifying the dimensions or assembly of the laminations by merely altering the length of the loop 36 prior to its being bonded to protrustion 14.

It will be appreciated that the present invention affords a novel wrist support device having unique features which render the device specially suitable as an aid in tennis and like sports.

I claim:

1. In a wrist support device for use in tennis comprising:

a band of a breathable flexible material means to permit fastening of said band about a persons wrist; and an integral protruding portion extending from the band in a direction to engage and support the side edge of a person's hand between the wrist and smallest finger;

the improvement wherein the protruding hand engaging portion extends from the band at an angle to the band in the range 45° to 80° in the plane of the flattened band, and means biasing said protruding portion to an equilibrium position out of said plane on the side of the band to be occupied by the hand, the force required to cause said protruding portion to occupy said plane being greater than ½ kgm force.

2. An improved wrist support device according to claim 1 wherein said angle is in the range 55° to 65°.

3. An improved wrist support device according to claim 1 wherein said outward force is not greater than 3 kgm force.

4. An improved wrist support device according to claim 3 wherein said outward force is in the range 1 to 2 kgm force.

5. An improved wrist support device according to any one of claims 1 to 4 further comprising a loop extending from the end of the protruding hand engaging portion which is remote from the band for supporting the device from the smallest finger of a persons.

6. An improved wrist support device according to any one of claims 1 to 4 wherein the protruding hand engaging portion is biased to adopt said equilibrium position out of the plane of the flattened band by way of a spring metal strip bridging the band and protruding portion.

7. An improved wrist support device according to any one of claims 1 to 4 wherein said band is of sufficient length to overlap about the wrist and includes cooperable Velcro-type loop and pile pads.

8. An improved wrist support device according to any one of claims 1 to 4 wherein the band includes relatively softer portions positioned to engage the wrist bone of the wearer.

* * * * *